US005691282A

United States Patent [19]

Periard et al.

[11] Patent Number: 5,691,282

[45] Date of Patent: Nov. 25, 1997

[54] LUBRICANT COMPOSITION FOR USE ON WORKPIECES IN THE HOT FORMING OF METALS

[75] Inventors: Jacques Periard, Sins; Hans-Rudolf Staub, Ottenbach, both of Switzerland

[73] Assignee: Timcal Ltd., Bodio, Switzerland

[21] Appl. No.: 648,958

[22] Filed: May 16, 1996

[30] Foreign Application Priority Data

May 16, 1995 [CH] Switzerland ..... 1416/95

[51] Int. Cl.[6] ..... C10M 125/28; C10M 125/02; C10M 173/02

[52] U.S. Cl. ..... 508/113; 508/125; 508/126; 508/127

[58] Field of Search ..... 508/113, 126, 508/125, 127

[56] References Cited

U.S. PATENT DOCUMENTS

| | | | |
|---|---|---|---|
| 3,242,076 | 3/1966 | Hagan | 508/126 |
| 3,485,753 | 12/1969 | Allais | 508/126 |
| 3,575,858 | 4/1971 | Adair et al. | 508/126 |
| 3,801,504 | 4/1974 | Stone | 508/125 |
| 4,039,337 | 8/1977 | Brown et al. | 508/127 |
| 4,096,076 | 6/1978 | Spiegelberg | 508/137 |
| 4,281,528 | 8/1981 | Spiegelberg et al. | 72/42 |
| 4,780,226 | 10/1988 | Sheets et al. | 508/126 |
| 5,242,506 | 9/1993 | Barber et al. | 508/137 |
| 5,244,587 | 9/1993 | Ito et al. | 508/138 |
| 5,493,886 | 2/1996 | Graham | 508/427 |

FOREIGN PATENT DOCUMENTS

| | | |
|---|---|---|
| 660023 A5 | 3/1987 | Switzerland . |
| 670106 A5 | 5/1989 | Switzerland . |

OTHER PUBLICATIONS

"Patent Abstracts of Japan", No. C–046, Oji Yutaka, Composite Lubricant for Hot Working; (Application No. JP790069769—Application Date: Apr. 6, 1979), Patent date: Dec. 1980.

*Primary Examiner*—Ellen M. McAvoy
*Attorney, Agent, or Firm*—Fisher, Christen & Sabol

[57] ABSTRACT

Lubricant composition for use on workpieces in the hot forming of metals, which contains:

($a_1$) 0 to 80 percent by weight of a glass powder, ($a_2$) 0 to 50 percent by weight of a glass frit whereby the content of at least one component ($a_1$) or ($a_2$) in the lubricant composition is not 0 percent by weight, (b) 10 to 25 percent by weight of natural or synthetic graphite, (c) 5 to 20 percent by weight of one or more alkali metal silicates of the general formula $Me_2O.n\ SiO_2$, where Me is lithium, potassium or sodium and n is a number between 1 and 4, (d) 1 to 6 percent by weight of a water-soluble sodium polymetaphosphate, (e) 0 to 3 percent by weight of a water-insoluble sodium polymetaphosphate, (f) 0.5 to 4 percent by weight of a thickener, and (g) 0 to 1 percent by weight of borax.

26 Claims, No Drawings

LUBRICANT COMPOSITION FOR USE ON WORKPIECES IN THE HOT FORMING OF METALS

BACKGROUND OF THE INVENTION

1. Field of the Invention

The invention relates to a new lubricant composition for use on workpieces in the hot forming of metals, and in particular for use in the hot rolling of blocks and profiles or in the production of hollow blocks in push bench plants.

2. Background Art

Owing to the fact that the metals to be worked have a surface temperature of from about 800° to 1300° C., the practice has hitherto been to concentrate on the lubrication of workpieces which at temperatures of at most 400° C. are better accessible to classical lubrication.

Although it is disclosed in the prior art for example, in Swiss Patent No. 660,023, that workpieces at temperatures above 600° C. can also be treated with the lubricant dispersion mentioned therein, practical comparison shows no formation of an effective, adhering lubricant film at temperatures in the range from 800° to 1300° C. The lack of adhesion is caused essentially by the immediate pyrolysis of the organic constituents which makes adhesion of the film impossible. The pyrolysis of the organic constituents and the smoke formation associated therewith is additionally a very unpleasant accompanying effect for the working environment. In a practical test, formation of a lubricant film was also not found in the case of the lubricant/pickling agent compositions of Swiss Patent No. 670, 106 applied in powder form. Even just the uniform application of a powder mixture represents a considerable difficulty in this case.

However, the lubrication of the tools is also encumbered with various difficulties depending on the type of tool. Thus, the application of the lubricant is frequently made difficult simply by the geometry of the tool. Low tool temperatures of around 100° C. do not allow the proper formation of a lubricant film. The continual treatment of the tools with large amounts of cooling water additionally makes large losses of lubricant the rule, which results in contamination of the wastewater and makes appropriate treatment of the wastewater necessary. Relatively large amounts of lubricant are, therefore, required for good lubrication.

BROAD DESCRIPTION OF THE INVENTION

The object of the invention is to provide a lubricant composition which does not have the above-mentioned disadvantages and, as a result, is suitable for providing workpieces having surface temperatures of from 800° to 1300° C., with a uniform, well adhering and water-insoluble lubricant film.

The object of the invention is achieved by means of the new lubricant compositions of the invention, which comprises:

($a_1$) 0 to 80 percent by weight of a glass powder, ($a_2$) 0 to 50 percent by weight of a glass frit, whereby the content of at least one of the components of ($a_1$) and ($a_2$) in the lubricant composition is not 0 percent by weight, (b) 10 to 25 percent by weight of natural or synthetic graphite, (c) 5 to 20 percent by weight of one or more alkali metal silicates of the general formula $Me_2O.n\ SiO_2$, where Me is lithium, potassium or sodium and n is a number between 1 and 4, (d) 1 to 6 percent by weight of a water-soluble sodium polymetaphosphate, (e) 0 to 3 percent by weight of a water-insoluble sodium polymetaphosphate, (f) 0.5 to 4 percent by weight of a thickener, and (g) 0 to 1 percent by weight of borax.

For use with workpieces having surface temperatures above 800° C., preference is given to using a lubricant composition which comprises:

($a_1$) 0 to 20 percent by weight of a glass powder, ($a_2$) 30 to 50 percent by weight of a glass frit, (b) 20 to 25 percent by weight of natural or synthetic graphite, (c) 7 to 20 percent by weight of one or more alkali metal silicates of the general formula $Me_2O.n\ SiO_2$, where Me is lithium, potassium or sodium and n is a number between 1 and 4, (d) 2 to 6 percent by weight of a water-soluble sodium polymetaphosphate, (e) 0 to 1 percent by weight of a water-insoluble sodium polymetaphosphate, (f) 3 to 4 percent by weight of a thickener, and (g) 0.2 to 0.7 percent by weight of borax.

For use with workpieces having surface temperatures above 1000° C., preference is given to using a lubricant composition which comprises:

($a_1$) 45 to 70 percent by weight of a glass powder, ($a_2$) 0 to 20 percent by weight of a glass frit, (b) 20 to 25 percent by weight of natural or synthetic graphite, (c) 7 to 20 percent by weight of one or more alkali metal silicates of the general formula $Me_2O.n\ SiO_2$, where Me is lithium, potassium or sodium and n is a number between 1 and 4, (d) 1 to 2 percent by weight of a water-soluble sodium polymetaphosphate, (e) 0 to 1 percent by weight of a water-insoluble sodium polymetaphosphate, (f) 1.5 to 2 percent by weight of a thickener, and (g) 0 to 0.25 percent by weight of borax.

The glass powder used is advantageously a normal glass having an average particle diameter $d_{50}$ of <100 μm and a softening range from about 700° to 900° C. (CAS No. 65997-17-3). The glass powder is primarily responsible for the excellent film properties of the lubricant. Owing to its relatively high softening point, it is used in an increasing amount when the surface temperature of the workpiece exceeds the 1000° C. mark.

In contrast, the glass frit is used particularly when the use temperatures are in the lower range above about 800° C.

Then, owing to the lower (in comparison with the glass powder) softening range from about 500° to 700° C., the film-forming properties of the glass flit become fully effective. In terms of its chemical composition, the glass frit is advantageously an alkali metal/alkaline earth metal aluminoborosilicate and is usually used in an average particle size $d_{50}$ of <100 μm.

Glass powder and glass frit can be used in any mixing ratios depending on the use within the boundaries indicated.

A further essential constituent is the graphite. Either a synthetic graphite or a natural graphite can be used. The average particle size $d_{50}$ of the graphite employed is appropriately less than 100 μm. Advantageously, a graphite having a high crystallinity, i.e., having a crystallite length $L_c$ of greater than 100 nm, is used.

The water soluble alkali metal silicates assume an essential function as binders. Use is made of water-soluble alkali metal silicates, individually or in admixture, of the general formula MeO.n $SiO_2$, where Me is lithium, potassium or sodium and n is a number between 1 and 4. Preference is given to using a sodium metasilicate of said general formula where n is 1 to 1.5 or a sodium silicate where n is 3.3 to 3.5 (water glass) or a eutectic mixture of the said sodium silicates with a potassium silicate of the general formula $K_2O.n\ SiO_2$ where n is 2.4 to 3 and/or a lithium silicate of the general formula $Li_2O.n\ SiO_2$ where n is 2.4 to 3. Particular preference is given to using a mixture of the said preferred alkali metal silicates in a ratio of sodium silicate: potassium silicate: lithium silicate of 12.3 percent: 67.5 percent: 20.7 percent.

The function of a lubricant constituent which suppresses foam formation is fulfilled by a water-soluble sodium metapolyphosphate. For the purposes of the present invention, this means a compound of the general formula $(NaPO_3)_n$ where n is less than 450. These compounds are also known as "hexametaphosphate" or "Graham salt".

Furthermore, a water-insoluble sodium polymetaphosphate can be added to function as a binder. Particularly suitable for this purpose are the compounds of the general formula $(NaPO_3)_n$ where n is from 40 to 70, known under the name "Maddrell salt".

The addition of a thickener, advantageously a polysaccharide or a polysaccharide derivative, is decisive for ensuring a constant viscosity and stability of the lubricant dispersion over a wide temperature range, and for reducing the sedimentation of the solids in the dispersion. Biopolysaccharides such as xanthan gum, rhamsan gum or an alkylcellulose such as hydroxymethylcellulose are advantageously used.

A similar result is given by the addition of alkali metal salts of polyacrylic acid, in particular sodium polyacrylates, as thickeners.

To prevent bacterial attack, a commercial biocide is advantageously added to the lubricant composition.

Finally, it is possible to add borax (sodium tetraborate decahydrate) as a coupling agent.

The lubricant of the invention is advantageously used in the form of an aqueous dispersion having a solids content of preferably from 20 to 50 percent. The boundaries can be varied upward or downward. The dispersion can be produced in commercial dispersion apparatus in which high shear forces can be achieved (cf., for example, European Published Patent Application No. B 218,989). The ready-to-use dispersion advantageously has a viscosity in the range from 1000 MPas to 7000 MPas (Rheomat 15, 20° C., cell B, speed 5), but can also be further varied by the addition of thickeners.

Application of the lubricant dispersion can be carried out by means of known systems for spraying dispersed systems (cf., for example, European published Patent Application No. A 453,801).

According to the invention, the above-disclosed lubricant composition is used on workpieces having surface temperatures of from 800° to 1300° C. in the hot forming of metals, in particular the hot rolling of blocks and profiles or in the production of hollow blocks in push bench plants. The application of the dispersion onto the workpiece is here carried out immediately prior to forming. Preliminary descaling of the workpiece is advantageous but not absolutely necessary. After the immediate vaporization of the water, a uniform, water-insoluble lubricating film is formed on the workpiece surface within a few seconds, and this film is not impaired by the subsequent forming process.

Examples

The viscosity data reported below was measure in a Rheomat 15 (20° C., cell B, speed 5).

Formulation 1 (suitable for workpieces having surface temperatures of 850° to 1200° C.):

49.17 percent by weight of a glass frit (binder frit K2244 having $d_{70}$ <100 μm, Schauer Co., Vienna, Austria), 25.00 percent by weight of graphite (synthetic graphite T 75 having $d_{50}$=24 μm, TIMCAL Ltd. , Bodio, Switzerland), 15.67 percent by weight of water glass (water-soluble sodium silicate $Na_2O.n\ SiO_2$ where n =3.3 to 3.5), 6.00 percent by weight of water-soluble sodium polyphosphate (Alcopon, Benckiser-Knapsack, Ladenburg, Germany), 3.33 percent by weight of hydroxymethylcellulose (Dow Chemical), 0.67 percent by weight of borax, and 0.16 percent by weight of biocide.

Dispersion: 20 percent in water

Viscosity: 1000 to 2000 MPas

Formulation 2 (suitable for workpieces having surface temperatures of 100° to 1250° C.):

64.85 percent by weight of glass powder (glass powder 300 having $d_{70}$<63 μm from Mineralienwerke Kuppenheim), 4.94 percent by weight of graphite (synthetic graphite T 75 having $d_{50}$=24 μm, TiMCAL Ltd. , Bodio, Switzerland), 6.98 percent by weight of water-soluble sodium silicate ($Na_2O.n\ SiO_2$ where n =1 to 1.15), 1.67 percent by weight of water-soluble sodium polyphosphate (Alcopon, Benckiser-Knapsack, Ladenburg, Germany), 1.33 percent by weight of hydroxymethylcellulose (Dow Chemical), 0.22 percent by weight of xanthan gum, and 0.01 percent by weight of biocide.

Dispersion: 40 percent in water

Viscosity: 1000 to 3000 MPas

Formulation 3 (suitable for workpieces having surface temperatures of 1000° to 1250° C.):

47.78 percent by weight of glass powder (glass powder 300 having $d_{70}$<63 μm from Mineralienwerke Kuppenheim), 16.53 percent by weight of glass flit (binder frit K2244 having $d_{70}$<100 μm, Schauer Co., Vienna, Austria), 24.84 percent by weight of graphite (synthetic graphite T 75 having $d^{50}$=24 μm, TIMCAL Ltd., Bodio, Switzerland), 6.74 percent by weight of water-soluble alkali metal silicate mixture (sodium silicate: potassium silicate: lithium silicate =12.3%:67.5%:20.7%, $Me_2O.n\ SiO_2$ where n =2.7), 1.32 percent by weight of water-soluble sodium polyphosphate (Alcopon, Benckiser-Knapsack, Ladenburg, Germany), 0.92 percent by weight of water-insoluble sodium polyphosphate (Dentphos M, Benckiser-Knapsack, Ladenburg, Germany), 0.25 percent by weight of borax, 0.45 percent by weight of xanthan gum, 1.10 percent by weight of hydroxymethylcellulose (Dow Chemical), and 0.07 percent by weight of biocide.

Dispersion: 40 percent in water
Viscosity: 2000 to 5000 MPas

Formulation 4 (suitable for workpieces having surface temperatures of 850° to 1250° C.):

49.53 percent by weight of glass frit (binder frit K2244 having $d_{70}$<100 μm, Schauer Co., Vienna, Austria), 24.76 percent by weight of graphite (synthetic graphite T 75 having $d^{50}$=24 μm, TIMCAL Ltd. , Bodio, Switzerland), 6.74 percent by weight of water-soluble alkali metal silicate mixture (sodium silicate: potassium silicate: lithium silicate =12.3%:67.5%:20.7%, $Me_2O.n\ SiO_2$ where n =2.7), 2.64 percent by weight of water-soluble sodium polyphosphate (Alcopon, Benckiser-Knapsack, Ladenburg, Germany), 1.32 percent by weight of water-insoluble sodium polyphosphate (Dentphos M, Benckiser-Knapsack, Ladenburg, Germany), 0.66 percent by weight of borax, 3.30 percent by weight of hydroxymethylcellulose (Dow Chemical), 0.71 percent by weight of sodium polyacrylate (Carbopol, Goodrich Chemical), and 0.14 percent by weight of biocide.

Dispersion: 20 percent in water
Viscosity: 2000 to 5000 MPas

Comparative Formulation 1: (as described in Swiss Patent No. 660.023.

Example 1)

54 percent by weight of crystalline graphite, 11 percent by weight of Maddrell salt, 5 percent by weight of borax, 10 percent by weight of sodium silicate (water glass $SiO_2/NaO_2$=3.3), 18 percent by weight of polyethylene, and 2 percent by weight of alkylcellulose.

Aqueous dispersion having a solids content of 30 percent by weight.
Viscosity: 1900 MPas Powder Mixture Comparative Test:
Test conditions:

Formulations 1 to 4 and comparative formulation 1 are sprayed onto the surface, which is at from 800° to 1050° C., of a vertical steel block moved at 1.5 m/s and having the dimensions 29 cm×6 cm×3 cm by means of a nozzle (pressure 50 bar) located at a distance of 43 cm. The comparative formulation 2 is sprayed dry as described in Swiss Patent No. 670,106. The lubricant film is evaluated according to the following classifications.

Class 1

No formation of a lubricant film.

Class 2

Formation of a crumbly lubricant film which adheres for only a short time (a few seconds).

Class 3

Immediate formation of a uniform, glass-like, well-adhering lubricant film having a high mechanical strength and high water resistance.

Test results:

| FORMULATION | TEST RESULT (CLASS) |
|---|---|
| 1 | 3 (above 850° C.) |
| 2 | 3 (above 1000° C.) |
| 3 | 3 (above 1000° C.) |
| 4 | 3 (above 850° C.) |
| Comparison 1 | 1 |
| Comparison 2 | 2 |

What is claimed is:

1. Lubricant composition for use on workpieces in the hot forming of metals, which comprises:

($a_1$) 0 to 80 percent by weight of a glass powder ($a_2$) 0 to 50 percent by weight of a glass frit whereby the content of at least one component ($a_1$) or ($a_2$) in the lubricant composition is not 0 percent by weight, (b) 10 to 25 percent by weight of natural or synthetic graphite, (c) 5 to 20 percent by weight of one or more alkali metal silicates of the general formula $Me_2O.n\ SiO_2$, where Me is lithium, potassium or sodium and n is a number between 1 and 4, (d) 1 to 6 percent by weight of a water-soluble sodium polymetaphosphate, (e) 0 to 3 percent by weight of a water-insoluble sodium polymetaphosphate, (f) 0.5 to 4 percent by weight of a thickener, and (g) 0 to 1 percent by weight of borax.

2. The lubricant composition according to claim 1, wherein the glass powder used has an average particle diameter $d_{50}$ of <100 μm and a softening range of about 700° to 900° C.

3. The lubricant composition according to claim 2, wherein the glass frit used has an average particle diameter $d_{50}$ of <100 μm and a softening range of about 500° to 700° C.

4. The lubricant composition according to claim 3, wherein water-soluble alkali metal silicates of the general formula $Me_2O.n\ SiO_2$, where Me is lithium, potassium or sodium and n is a number between 1 and 4, are used individually or in an admixture.

5. The lubricant composition according to claim 4, wherein the water-soluble sodium polymetaphosphate used is a Graham salt of the general formula $(NaPO_3)_n$ where n is less than 450.

6. The lubricant composition according to claim 6, wherein the water-soluble sodium polymetaphosphate used is a Maddrell salt of the general formula $(NaPO_3)_n$ where n is from 40 to 70.

7. The lubricant composition according to claim 6, wherein the thickener used is a polysaccharide, a polysaccharide derivative or an alkali metal salt of a polyacrylate.

8. The lubricant composition according to claim 7 which is in the form of an aqueous dispersion.

9. The lubricant composition according to claim 8 which is in the form of an aqueous dispersion having a solids content of from 20 to 50 percent.

10. The lubricant composition according to claim 9 for use with workpieces having surface temperatures above 800° C., which comprises:

($a_1$) 0 to 20 percent by weight of a glass powder, ($a_2$) 30 to 50 percent by weight of a glass frit, (b) 20 to 25 percent by weight of natural or synthetic graphite, (c) 7 to 20 percent by weight of one or more alkali metal silicates of the general formula $Me_2O.n\ SiO_2$, where Me is lithium, potassium or sodium and n is a number between 1 and 4, (d) 2 to 6 percent by weight of a water-soluble sodium polymetaphosphate, (e) 0 to 1 percent by weight of a water-insoluble sodium polymetaphosphate, (f) 3 to 4 percent by weight of a thickener, and (g) 0.2 to 0.7 percent by weight of borax.

11. The lubricant composition according to claim 9 for use with workpieces having a surface temperature above 1000° C., which comprises:

($a_1$) 45 to 70 percent by weight of a glass powder, ($a_2$) 0 to 20 percent by weight of a glass frit, (b) 20 to 25 percent by weight of natural or synthetic graphite, (c) 7 to 20 percent by weight of one or more alkali metal silicates of the general formula $Me_2O.n\ SiO_2$, where Me is lithium, potassium or sodium and n is a number between 1 and 4, (d) 1 to 2 percent by weight of a water-soluble sodium polymetaphosphate, (e) 0 to 1 percent by weight of a water-insoluble sodium polymetaphosphate, (f) 1.5 to 2 percent by weight of a thickener, and (g) 0 to 0.25 percent by weight of borax.

12. The lubricant composition according to claim 1, wherein the glass frit used has an average particle diameter $d_{50}$ of <100 μm and a softening range of about 500° to 700° C.

13. The lubricant composition according to claim 1, wherein water-soluble alkali metal silicates of the general formula $Me_2O.n\ SiO_2$, where Me is lithium, potassium or sodium and n is a number between 1 and 4, are used individually or in admixture.

14. The lubricant composition according to claim 1, wherein the water-soluble sodium polymetaphosphate used is a Graham salt of the general formula $(NaPO_3)_n$ where n is less than 450.

15. The lubricant composition according to claim 1, wherein the water-soluble sodium polymetaphosphate used is a Maddrell salt of the general formula $(NaPO_3)_n$ where n is from 40 to 70.

16. The lubricant composition according to claim 1, wherein the thickener used is a polysaccharide, a polysaccharide derivative or an alkali metal salt of a polyacrylate.

17. The lubricant composition according to claim 1 which is in the form of an aqueous dispersion.

18. The lubricant composition according to claim 1 which is in the form of an aqueous dispersion having a solids content of from 20 to 50 percent.

19. The lubricant composition according to claim 1 for use with workpieces having surface temperatures above 800° C., which comprises:

($a_1$) 0 to 20 percent by weight of a glass powder, ($a_2$) 30 to 50 percent by weight of a glass frit, (b) 20 to 25 percent by weight of natural or synthetic graphite, (c) 7 to 20 percent by weight of one or more alkali metal silicates of the general formula $Me_2O.n\ SiO_2$, where Me is lithium, potassium or sodium and n is a number between 1 and 4, (d) 2 to 6 percent by weight of a water-soluble sodium polymetaphosphate, (e) 0 to 1 percent by weight of a water-insoluble sodium polymetaphosphate, (f) 3 to 4 percent by weight of a thickener, and (g) 0.2 to 0.7 percent by weight of borax.

20. The lubricant composition according to claim 1 for use with workpieces having a surface temperature above 1000° C., which comprises:

($a_1$) 45 to 70 percent by weight of a glass powder, ($a_2$) 0 to 20 percent by weight of a glass frit, (b) 20 to 25 percent by weight of natural or synthetic graphite, (c) 7 to 20 percent by weight of one or more alkali metal silicates of the general formula $Me_2O.n\ SiO_2$, where Me is lithium, potassium or sodium and n is a number between 1 and 4, (d) 1 to 2 percent by weight of a water-soluble sodium polymetaphosphate, (e) 0 to 1 percent by weight of a water-insoluble sodium polymetaphosphate, (f) 1.5 to 2 percent by weight of a thickener, and (g) 0 to 0.25 percent by weight of borax.

21. The process of using the lubricant composition according to claim 1 for the direct lubrication of workpieces having a surface temperature of from about 800° to 1300° C. in the hot forming of metals.

22. The lubricant composition according to claim 1, wherein the water-insoluble sodium polymetaphosphate is present in an amount of up to, and including, 3 percent by weight, and the borax is present in an amount of up to, and including, 1 percent by weight.

23. The lubricant composition according to claim 10, wherein the water-insoluble sodium polymetaphosphate is present in an amount of up to, and including, 3 percent by weight, and the borax is present in an amount of up to, and including, 1 percent by weight.

24. The lubricant composition according to claim 11, wherein the water-insoluble sodium polymetaphosphate is present in an amount of up to, and including, 3 percent by weight, and the borax is present in an amount of up to, and including, 1 percent by weight.

25. The lubricant composition according to claim 19, wherein the water-insoluble sodium polymetaphosphate is present in an amount of up to, and including, 3 percent by weight, and the borax is present in an amount of up to, and including, 1 percent by weight.

26. The lubricant composition according to claim 20, wherein the water-insoluble sodium polymetaphosphate is present in an amount of up to, and including, 3 percent by weight, and the borax is present in an amount of up to, and including, 1 percent by weight.

* * * * *